US006130499A

United States Patent [19]

Koizumi et al.

[11] Patent Number: 6,130,499

[45] Date of Patent: Oct. 10, 2000

[54] CATHODE RAY TUBE HAVING AN IMPROVED CATHODE STRUCTURE

[75] Inventors: Sachio Koizumi; Toshifumi Komiya, both of Mobara, Japan

[73] Assignee: Hitachi, Ltd., Tokyo, Japan

[21] Appl. No.: 09/074,315

[22] Filed: May 8, 1998

[30] Foreign Application Priority Data

May 12, 1997 [JP] Japan ..... 9-120928

[51] Int. Cl.[7] ..... H01J 29/50

[52] U.S. Cl. ..... 313/314; 313/412

[58] Field of Search ..... 313/412, 414, 313/415, 428, 432, 456

[56] References Cited

U.S. PATENT DOCUMENTS

| | | | |
|---|---|---|---|
| 5,099,170 | 3/1992 | Koizumi . | |
| 5,723,938 | 3/1998 | Kato et al. | 313/412 |
| 5,734,235 | 3/1998 | Noguchi | 313/414 |
| 5,763,993 | 6/1998 | Park et al. | 313/414 |
| 5,798,603 | 8/1998 | Tsuruoka et al. | 313/414 |

FOREIGN PATENT DOCUMENTS

| | | |
|---|---|---|
| 56-109429 | of 1981 | Japan . |
| 57-32532 | of 1982 | Japan . |
| 58-28154 | of 1983 | Japan . |
| 146977 | of 1989 | Japan . |
| 2165842 | of 1990 | Japan . |

*Primary Examiner*—Vip Patel
*Assistant Examiner*—Mariceli Santiago
*Attorney, Agent, or Firm*—Antonelli, Terry, Stout & Kraus, LLP

[57] ABSTRACT

A color cathode ray tube includes an electron gun having a plurality of cathodes and a cup-shaped first grid electrode spaced from the cathodes. The plurality of cathodes are supported within a plurality of eyelets corresponding to the number of the cathodes, respectively. The eyelets are disposed within and bonded to a tubular cathode support by bonding glass contained within the tubular cathode support, and satisfy the following relationship: (1.4 times a beam spacing S between two electron beams from the two adjacent cathodes divided by an outside radius of the eyelets−1.4 mm)≧(a height of the eyelets protruding beyond the top surface of the bonding glass)≧(0.98 times the beam spacing S divided by the outside radius of the eyelets−1.4 mm).

5 Claims, 6 Drawing Sheets

CATHODE RAY TUBE HAVING AN IMPROVED CATHODE STRUCTURE

BACKGROUND OF THE INVENTION

The present invention relates to a cathode ray tube having an improved cathode structure, and particularly to a cathode ray tube having an electron gun having a plurality of cathodes supported within respective eyelets of a glass-bonded cathode support assembly which is in turn fixed within and to a cup-shaped first grid electrode, and capable of retaining the insulation strength of the glass-bonded cathode support assembly for a long period of time.

Generally, color cathode ray tubes such as a color picture tube and a color display tube comprise a phosphor screen formed on an inner surface of a faceplate of a panel portion of an evacuated envelope, a shadow mask having a multiplicity of electron beam apertures and spaced from the phosphor screen within the panel portion, an electron gun of the in-line type housed within a neck portion of the evacuated envelope, and a deflection yoke mounted around a funnel portion of the evacuated envelope.

In the operation of the color cathode ray tube, three electron beams emitted from the electron gun are deflected by the deflection yoke and thereafter are projected onto picture elements of the corresponding colors of the phosphor screen through the electron beam apertures of the shadow mask to display a desired color image on the phosphor screen.

FIGS. 6A and 6B are constitutional views showing an example of the constitution of an electron gun used for a conventional color cathode ray tube, FIG. 6A being a side view thereof, and FIG. 6B being a top view thereof.

In FIGS. 6A and 6B, reference numeral 30 designates a cathode; 31 a cup-shaped first grid electrode (G1); 32 a second grid electrode (G2); 33 a third grid electrode (G3); 34 a fourth grid electrode (G4); 35 a fifth electrode (G5); 36 a sixth grid electrode (G6); 37 a shield cup; 38 multiform glass rods; 39 a stem; and 40 an electron gun. In this case, only one cathode 30 is shown, but actually there are three electron guns arranged in a line.

The cathodes 30, the cup-shaped first grid electrode 31, the second grid electrode 32, the third grid electrode 33, the fourth grid electrode 34, the fifth grid electrode 35, the sixth grid electrode 36, and the shield cup 37 are mounted, in order named from the stem 39, in spaced relationship between the pair of multiform glass rods 38 spaced from each other and arranged parallel with each other. This beaded assembly is supported on the stem 39.

The cathodes 30, the cup-shaped first grid electrode 31, the second grid electrode 32, the third grid electrode 33, the fourth grid electrode 34, the fifth grid electrode 35, the sixth grid electrode 36, and the shield cup 37 are supported on and secured to the pair of multiform glass rods 38 through electrode supports. The electron gun 40 is held in place within the neck portion in such a manner that the stem 39 mounting the electron gun 40 thereon is heat-sealed to the open end of the neck portion of the color cathode ray tube, and bulb spacer contacts 200 welded to the shield cup 37 hold the forward end of the electron gun 40 centered in the neck portion.

FIGS. 7A and 7B are a plan view and a sectional view, respectively, showing the constitution of a portion supporting cathodes of an electron gun 40 proposed in Japanese Patent Application Laid-Open No. 56-109429 Publication. Cathodes 30B, 30G and 30R composed of a cathode cap 150 provided with an electron-emissive surface, a cathode sleeve 151, and a skirt portion 152 are secured to an insulating substrate 120*b* by metal supports 170. The insulating substrate 120*b* is secured within the cup-shaped first grid portion 31 (FIG. 6A) by a metal member 110.

Normally, when the color cathode ray tube is operated for a long period of time, metal components are evaporated from cathodes 30G, 30B and 30R, and the evaporated metal deposit on the constituent parts arranged in proximity to the cathodes. It has been known that, where the cathodes 30G, 30B and 30R are, for example, oxide cathodes, evaporated metals are magnesium Mg from a cap-shaped base metal 150 containing Mg serving as a reducing agent, a chrome (Cr) from a metal sleeve 151. These metals deposit on the surface of the insulating substrate 120*b* with time of operation and deteriorate the insulation strength.

In FIG. 7B, in order to prevent the insulation strength of the electron gun from deteriorating, the top surface of the insulating substrate 120*b* is made slightly little higher than the upper open end of the metal member 110, and a step 130 is provided between the top surface of the insulating substrate 120*b* and the edge of the opening of the metal member.

With the above described constitution, even if the metals evaporated from the three cathodes 30G, 30B and 30R fall on the top surface of the insulating substrate 120*b* beyond the metal support 170 and contaminate the top surface of the substrate 120*b* with time of operation, the vertical part of the step 130 provided between the top surface of the substrate 120*b* and the upper open end of the metal member 110 is a shadow zone not irradiated by the evaporated metals such that the contamination by metals do not develop in the step 130, and the insulation strength is secured between the metal support 170 and the metal member 110.

Further, in the constitution described in Japanese Patent Application Laid-Open No. 56-109429 Publication, there is provided the following arrangement for preventing the deterioration of the electric insulation characteristics caused by the evaporation or sputtering of material constituting the cathode. In FIG. 7A, a line-of-sight passing through the upper end of the metal support 170 from the edge of the cathode cap 150 is designed so as to strike a point A as illustrated in FIG. 7A which is on the edge of the opening of the metal member 110 and is equidistant from the two adjacent cathodes 30B and 30G. The following is a relationship required in this case:

$$H=(L-LA)\times HA\div(L-LB)$$

where

H is a protruding height of the metal support 170 beyond the insulating substrate 120*b*, $$L=\{(S/2)^2+LL^2\}^{0.5}\approx S/2^{0.5},$$

LL is a distance from the center of the cathodes 30B, 30G and 30R to the edge of the opening of the metal member 110, LA is a radius of the metal support 170, and LB is a radius of the cathode cap 150.

However, the invention described in Japanese Patent Application Laid-Open NO. 56-109429 Publication does not take into account a prevention of occurrence of a leakage path between the adjacent metal supports 170 on the insulating substrate 120*b* formed directly by the sputtering or evaporation from the two adjacent cathodes 30B and 30G.

SUMMARY OF THE INVENTION

The present invention eliminates those problems as noted above, and an object of the invention is to provide a color cathode ray tube having a constitution for preventing the deterioration of the insulation strength between a plurality of cathodes and a first grid electrode or between a plurality of cathodes.

For achieving the aforesaid object, a color cathode ray tube of the present invention comprises at least an evacuated envelope comprising a panel portion having a phosphor screen formed on an inner surface thereof, a neck portion, and a funnel portion connecting the panel portion and the neck portion, a shadow mask spaced from the phosphor screen and suspended within the panel portion, an electron gun housed in the neck portion comprising at least a plurality of cathodes, a cup-shaped first grid electrode spaced from the plurality of cathodes and a plurality of electrodes spaced between the first grid electrode and the shadow mask for generating and directing a plurality of electron beams toward the phosphor screen, and a deflection yoke mounted in the vicinity of the junction between the neck portion and the funnel portion, the plurality of cathodes being supported within a plurality of eyelets corresponding to the number of the cathodes, respectively, the plurality of eyelets comprising a large-diameter upper portion facing the cup-shaped first grid electrode, a small-diameter lower portion for supporting the plurality of cathodes and a funnel portion for connecting the large-diameter portion and the small-diameter portion, and being disposed within and bonded to a tubular cathode support at the large-diameter upper portion thereof by a bonding glass contained within the tubular cathode support, and the tubular cathode support being disposed within and fixed to the first grid electrode, wherein the bonding glass provides a protrusion beyond an upper open end of the tubular cathode support, the protrusion is provided with a depressed step around a top edge thereof, and (1.4 times a beam spacing S between two electron beams from two adjacent ones of the plurality of cathodes divided by an outside radius of the plurality of eyelets−1.4 mm)≧(a height of the plurality of eyelets protruding above a top surface of the bonding glass)≧(0.98 times the beam spacing S divided by the outside radius of the plurality of eyelets−1.4 mm).

According to the constitution of the present invention, the glass-bonded cathode support assembly is provided with a top surface of the bonding crystallized glass protruding beyond the open end of the dish portion of the tubular cathode support and a step of a narrow width around the circumference of the top surface of the crystallized glass. Therefore, even if, in operation of the color cathode ray tube, metal evaporates from the cathodes and flies toward the top surface of the crystallized glass, the evaporated metal does not deposit on a portion of a step which is shadowed, that is, whose unobstructed view is not possible, when the rim of the upper opening of the cathode support is viewed through the edge of the upper end of the eyelet from the cathode, and the insulation strength between the eyelets and the dish portion of the cathode support is sufficiently maintained so that a dark current does not flow between the eyelets and the cathode support regardless of a potential difference between the eyelets and the cathode support.

Further, according to the constitution of the present invention, the crystallized glass has the top surface protruding beyond the open end of the dish portion, and a depressed step of a narrow width is provided around the circumference of the top surface. Therefore, a portion of the protruding crystallized glass is prevented from moving toward and extending over the rim around the opening of the dish portion during operation of firing the crystallized glass and crack does not occur in the crystallized glass or a portion thereof does not chip off.

Further, according to the present invention, the relationship between the height of the eyelet protruding beyond the top surface of the bonding glass and the outside radius of the eyelet is specified as described above, and even if metals evaporate from the cathodes, a leakage path is prevented from forming between the eyelets arranged close to each other for supporting the cathodes.

BRIEF DESCRIPTION OF THE DRAWINGS

The drawings form an integral part of the specification and are to be read in conjunction therewith, in which like reference numerals designate similar components throughout the figures, and in which.

DETAILED DESCRIPTION OF THE PREFERRED EMBODIMENTS

Prior to the explanation of the present invention, the prior proposals made by the inventors of the present invention will be described for facilitating the understanding of the present invention. Except for electron guns used, the prior art cathode ray tube and a cathode ray tube in accordance with the inventors' prior proposal utilize the same cathode ray structure, and consequently, the detailed description of the structure depicted in FIGS. 6A and 6B is applicable to both.

Figure 4A:
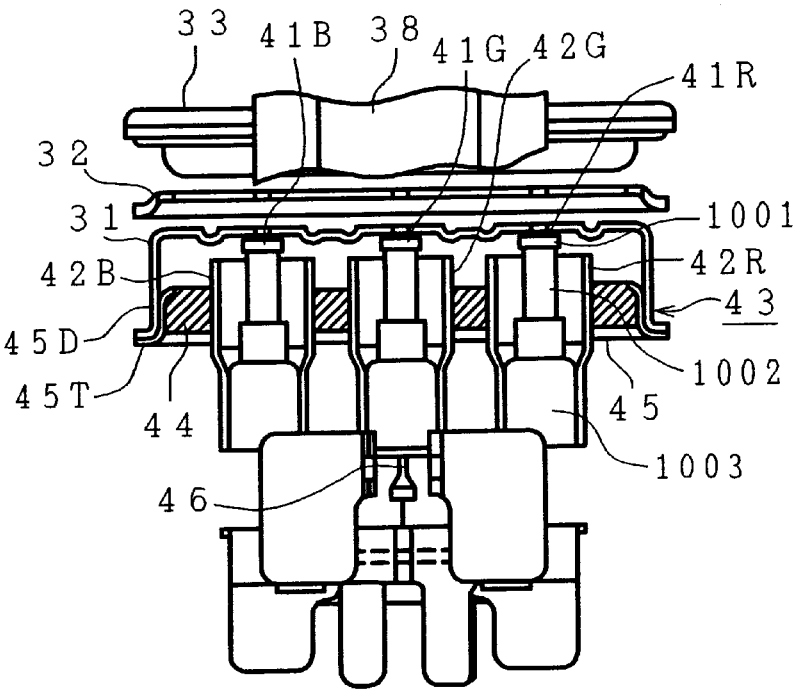
FIGS. 4A and 4B are respectively sectional views showing a constitution of a portion supporting cathodes of an electron gun according to a first prior proposal by the present inventor, FIG. 4A being a cross sectional view parallel with the in-line direction of the three electron beams, and FIG. 4B being a cross sectional view perpendicular to the in-line direction.
Figure 4B:
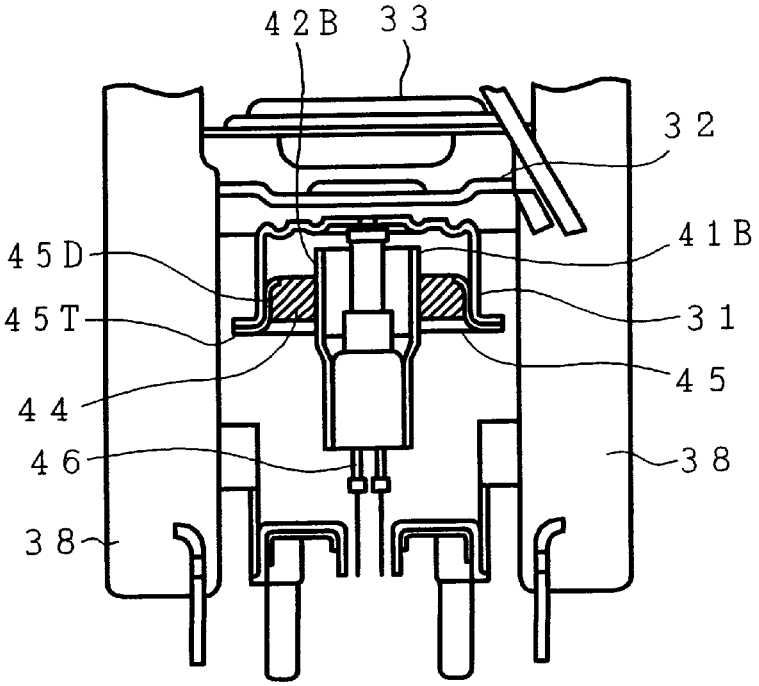
Figure 6A:
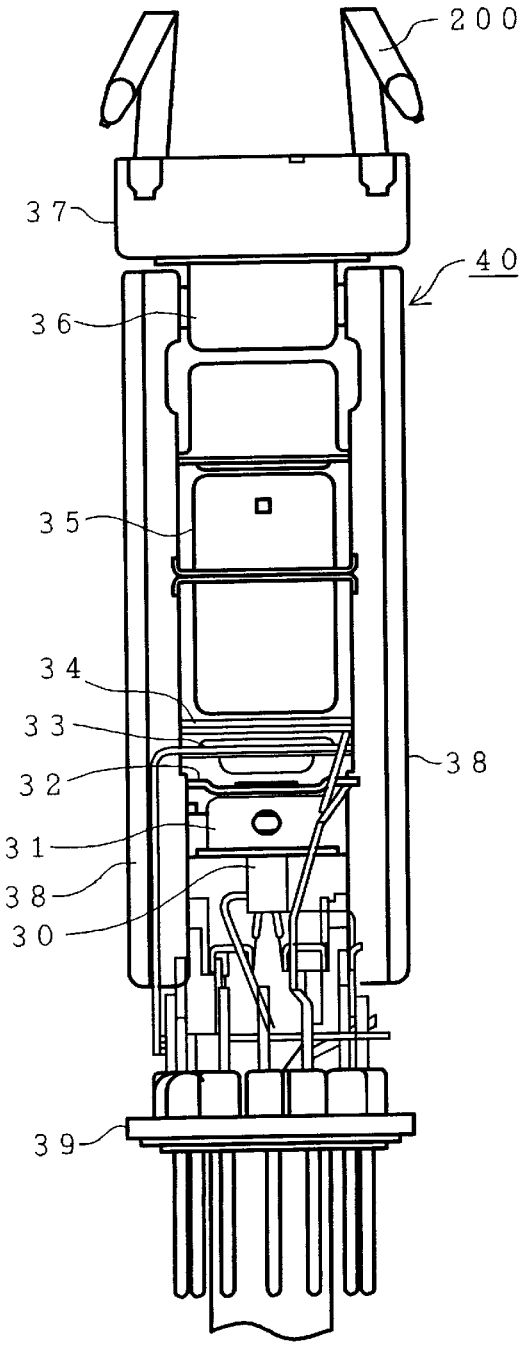
FIG. 6A (PRIOR ART)
FIGS. 6A and 6B are respectively constitutional views showing an example of a constitution of an electron gun of the color cathode ray tube according to the present invention, FIG. 6A being a side view thereof, and FIG. 6B being a top view thereof.
Figure 6B:
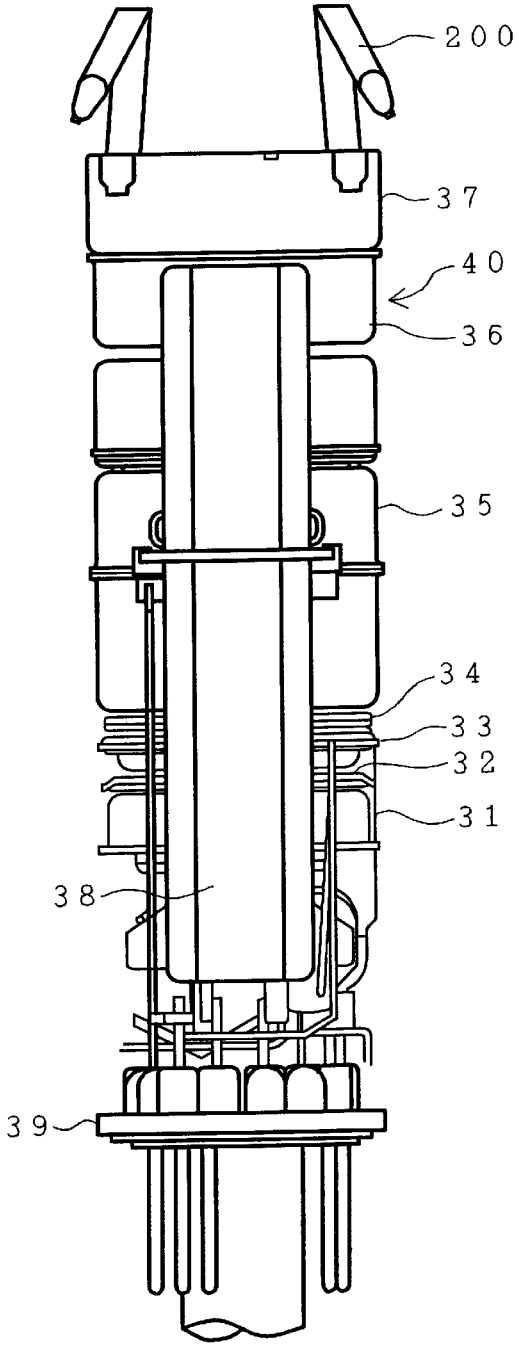
FIG. 6B (PRIOR ART)
Figure 7A:
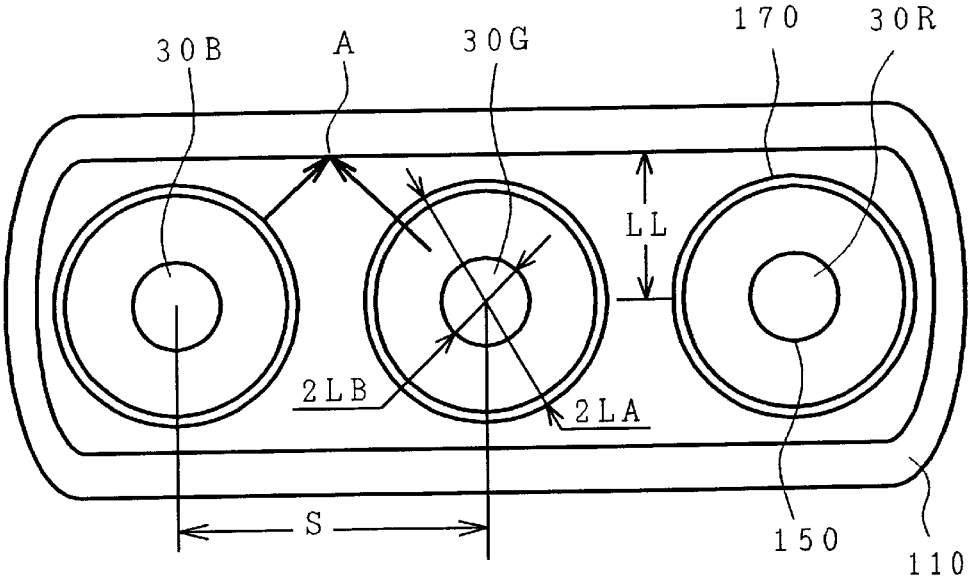
FIG. 7A (PRIOR ART)
FIGS. 7A and 7B are respectively a plan view and sectional view of a portion supporting cathodes according to a prior art.
Figure 7B:
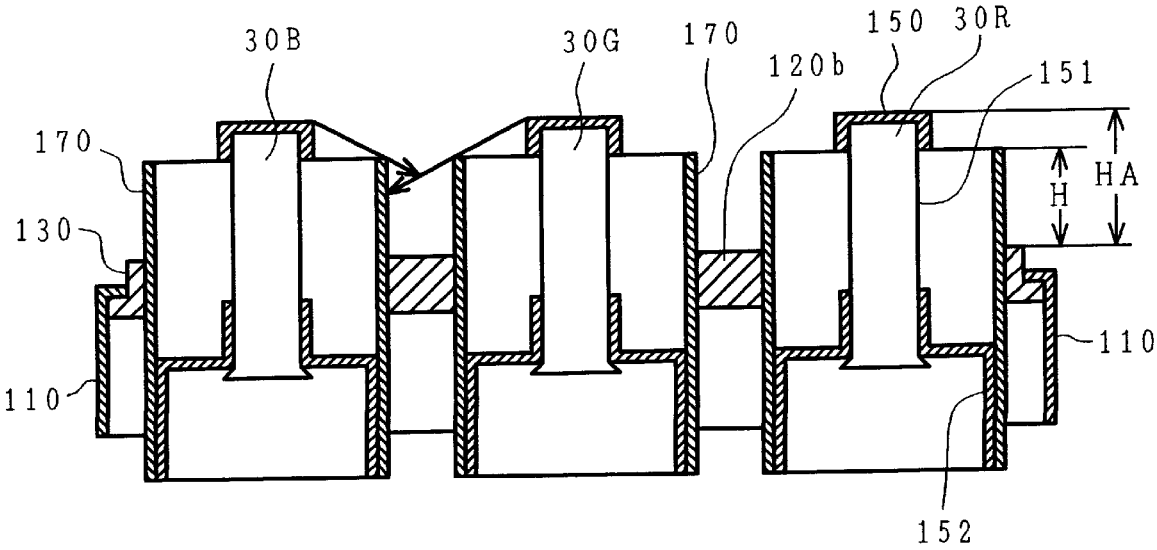
FIG. 7B (PRIOR ART)

FIGS. 4A and 4B are respectively sectional views showing a portion supporting a cathode according to the first prior proposal of the present inventors corresponding to the portion supporting the cathode of the electron gun 40 shown in FIGS. 6A and 6B, FIG. 4A being a cross sectional view parallel with the in-line direction of the three electron beams, and FIG. 4B being a cross sectional view perpendicular to the in-line direction.

In FIGS. 4A and 4B, reference numeral 41G designates a cathode for a green electron beam; 41B a cathode for a blue electron beam; 41R a cathode for a red electron beam; 42G, 42B, 42R eyelets; 43 a glass-bonded cathode support assembly; 44 a low-melting-temperature crystallized glass; 45 a tubular cathode support; 45D a dish portion thereof; 45T a flange portion thereof; and 46 heater leads. The same reference numerals as utilized in FIGS. 6A and 6B designate corresponding portions in FIGS. 4A and 4B.

Each of the cathodes 41G, 41B, 41R comprises a cathode cap 1001 having an electron emissive layer thereon, a cathode sleeve 1002 fitted in the cathode cap 1001 and a skirt portion 1003 connected to the lower open end of the cathode sleeve 1002.

The cathode 41G for a green beam disposed in the center is supported by an eyelet 42G, the cathode 41B for a blue beam on the left side of FIG. 4A is supported by an eyelet 42B, and the cathode 41R for a red beam on the right side of FIG. 4A is supported by an eyelet 42R.

Three eyelets 42G, 42B and 42R are composed of a large-diameter portion, a small-diameter portion, and a funnel portion for connecting the large-diameter portion to the small-diameter portion. The large-diameter portions of the cathode 41G for a green beam, the cathode for a blue beam 41B and the cathode 41R for a red beam are fitted in the small-diameter portions of the three eyelets 42G, 42B and 42R, respectively, to fix the cathodes 41G, 41B and 41R.

The bonded cathode support assembly 43 comprises a tubular cathode support 45 made of low-thermal-expansion metal, for example, an iron-nickel alloy and formed of a flange portion 45T and a dish portion 45D; a low-melting-temperature crystallized glass 44 mainly formed of ZnO and contained within the dish portion 45D; and three eyelets 42G, 42B and 42R embedded in the low-melting-temperature crystallized glass 44.

The crystallized glass 44 fixes the large-diameter portions of the three eyelets 42G, 42B and 42R within the dish portion 45D. The tubular cathode support 45 has the flange portion thereof 45T welded to the open end of the cup-shaped first grid electrode 31, and the dish portion 45D is disposed within and secured to the cup-shaped first grid electrode 31.

As described above, the glass-bonded cathode support assembly 43 having the three eyelets 42G, 42B and 42R fixed by the crystallized glass 44 can not only precisely establish the spacing between the electron emissive surfaces of the cathode 41G for a green beam, the cathode 41B for a blue beam and the cathode 41R for a red beam and the first grid electrode 31, but also eliminate or greatly reduce changes in the spacing caused by external vibration, shock, etc.

When the color cathode ray tube is operated for a long period of time, metal components evaporate from the cathodes 41G, 41B and 41R for green, blue and red beams, and are apt to deposit on the components disposed in proximity to the cathodes 41G, 41B and 41R. It is known that, where the cathodes 41G, 41B and 41R are, for example, oxide cathodes, the metal evaporated is Mg evaporated from a cap-shaped base metal 1001 containing Mg serving as a reducing agent, or Cr evaporated from a metal sleeve 1002, the metal deposits on the surface of the crystallized glass 44 with time of operation and deteriorates the insulation strength of the electron gun.

In order to prevent the deterioration of the insulation characteristic of the electron gun, the top surface of the low-melting-temperature crystallized glass 44 is made slightly higher than the upper open end of the opening of the dish portion 45D to provide a step between the top surface of the glass 44 and the upper open end of the dish portion 45D.

Figure 5:
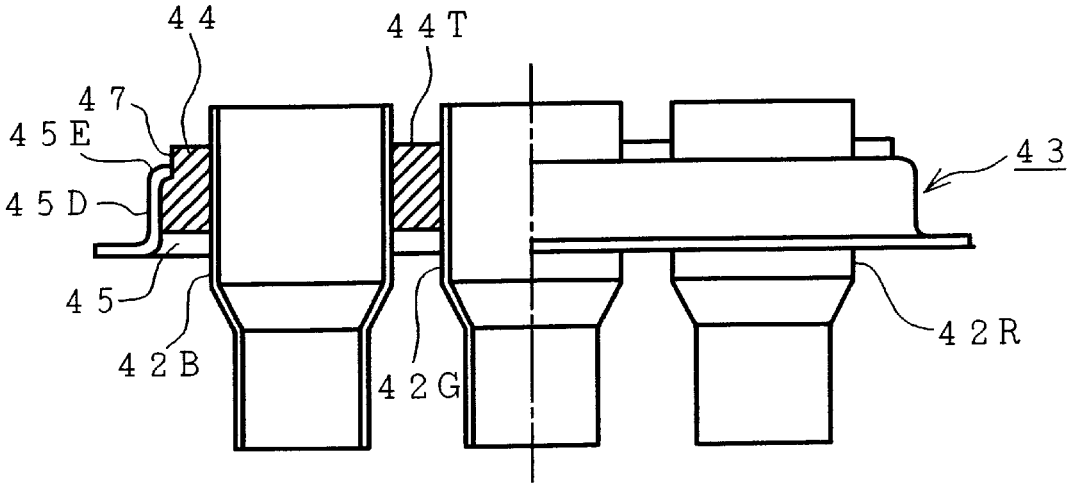
FIG. 5 is a sectional view showing a glass-bonded cathode support assembly according to a second prior proposal by the present inventor improved over the first prior proposal shown in FIGS. 4A and 4B.

FIG. 5 is a sectional view showing an example of the constitution of the glass-bonded cathode support assembly 43 according to the second prior proposal by the present inventors improved over the first prior proposal shown in FIGS. 4A and 4B.

In FIG. 5, reference numeral 44T designates a top surface of a crystallized glass 44; 45E an open end of the dish portion 45D; and 47 a step. The same reference numerals as utilized in FIGS. 4A and 4B designate corresponding portions in FIG. 5.

The low-melting-temperature crystallized glass 44 is contained in the dish portion 45D of the tubular cathode support 45 and shaped such that the top surface 44T is slightly higher than the open end 45E of the dish portion 45D, and a step 47 is formed between the top surface 44T and the open end 45E. The upper open ends of the three eyelets 42G, 42B and 42R protrude beyond the top surface 44T.

An example of a method of filling the low-melting-temperature crystallized glass 44 into the dish portion 45D is as follows: The three eyelets 42G, 42B and 42R are positioned at desired positions within the dish portion 45D, and material of the crystallized glass 44 is filled between the three eyelets 42G, 42B, 42R and the dish portion 45D. Then the material of the crystallized glass 44 is fired at approximately 800° C. in the nitrogen atmosphere by being shaped by a jig made of carbon. By the firing operation, the material of the crystallized glass 44 is molten, and the three eyelets 42G, 42B and 42R are fixed within the dish portion 45D.

With the glass-bonded cathode support assembly 43, when the color cathode tube is operated, even if the metal evaporated from the cathodes 41G, 41B and 41R deposits on the top surface 44T of the crystallized glass 44 beyond the eyelets 42G, 42B and 42R and contaminates the top surface 44T with time of operation, the step 47 provided between the top surface 44T and the open end 45E of the dish portion 45D is a shadow zone not irradiated by the evaporated metal whereby the contamination of the step 47 by the metal does not develop, and the insulation strength between the three eyelets 42G, 42B and 42R and the dish portion 45D is secured so that a dark current is not caused by a potential difference between the three eyelets 42G, 42B and 42R and the dish portion 45D of the tubular cathode support 45.

The color cathode ray tube employing the glass-bonded cathode support assembly as shown in FIG. 5 generally has the advantage that the contamination of the top surface 44T by the evaporated metals does not extend to the step 47 and a dark current is prevented from flowing between the three eyelets 42G, 42B and 42R and the dish portion 45D of the tubular cathode support 45.

In the color cathode tube as described above, to raise the top surface 44T of the crystallized glass 44 slightly beyond the open end 45E of the dish portion 45D and to form the step 47 between the top surface 44T and the open end 45E of the dish portion 45D, it is necessary to form the step 47 during the firing operation of the material of the crystallized glass 44. In this firing operation, a portion of the protruding crystallized glass 44 is apt to extend onto the rim of the open end 45E and produces a locally thin and mechanically weak portion in the crystallized glass 44, resulting in cracking or chipping-off of the portion. When chipping-off occurs in the crystallized glass 44, the created loose particles stick to electrodes of the electron gun, are stuck between two adjacent electrodes, and sometimes stick to the shadow mask or the like within the color cathode tube.

As described above, the color cathode ray tube by the prior proposal has a problem in that, during the firing operation of the crystallized glass 44, chipping-off of the crystallized glass 44 occurs and deteriorates the withstand voltage characteristics. When loose particles created by chipping-off stick to the shadow mask, defects of the phosphor screen occur.

The embodiments of the present invention will be explained in detail hereunder with reference to the accompanying drawings.

In the embodiments of the present invention, a cathode ray tube comprises a phosphor screen formed on an inner surface of a faceplate of a panel portion of an evacuated envelope, a shadow mask spaced from the phosphor screen within the panel portion, an electron gun housed in a neck portion of the evacuated envelope, and a deflection yoke mounted in the vicinity of the junction between the neck portion and the funnel portion of the evacuated envelope. The electron gun comprises at least a cup-shaped first grid electrode, a plurality of cathodes, and a glass-bonded cathode support assembly for fixing within the cup-shaped first grid electrode a plurality of eyelets which support a plurality of cathodes therein, respectively. The glass-bonded cathode support assembly comprises low-melting-temperature crystallized glass, a metal tubular cathode support provided with a dish portion for containing the low-melting-temperature crystallized glass and eyelets. The top surface of the crystallized glass protruding beyond the open end of the dish portion of the cathode support is formed with a step of a narrow width all around the circumference of the glass, and the lower surface of the step is made approximately level with the open end of the dish portion.

The step provided in the top surface of the crystallized glass in the embodiment of the present invention is such that the narrow width is within a range of from 0.1 mm to 1.0 mm, and the height of the top surface measured from the lower surface of the step is within a range of from 0.1 mm to 1.2 mm.

According to a concrete embodiment of the present invention, a color cathode ray tube comprises at least an evacuated envelope comprising a panel portion having a phosphor screen formed on an inner surface thereof, a neck portion, and a funnel portion connecting the panel portion and the neck portion, a shadow mask spaced from the phosphor screen and suspended within the panel portion, an electron gun housed in the neck portion comprising at least a plurality of cathodes, a cup-shaped first grid electrode spaced from the plurality of cathodes and a plurality of electrodes spaced between the first grid electrode and the shadow mask for generating and directing a plurality of electron beams toward the phosphor screen, and a deflection yoke mounted in the vicinity of the junction between the neck portion and the funnel portion, the plurality of cathodes being supported within a plurality of eyelets corresponding to the number of the cathodes, respectively, the plurality of eyelets comprising a large-diameter upper portion facing the cup-shaped first grid electrode, a small-diameter lower portion for supporting the plurality of cathodes and a funnel portion for connecting the large-diameter portion and the small-diameter portion, and being disposed within and bonded to a tubular cathode support at the large-diameter upper portion thereof by a bonding glass contained within the tubular cathode support, and the tubular cathode support being disposed within and fixed to the first grid electrode, wherein the bonding glass provides a protrusion beyond an upper open end of the tubular cathode support, the protrusion is provided with a depressed step around a top edge thereof, and (1.4 times a beam spacing S between two electron beams from two adjacent cathodes divided by an outside radius of the eyelets−1.4 mm)≧(a height of the plurality of eyelets protruding beyond a top surface of the bonding glass)≧(0.98 times the beam spacing S divided by the outside radius of the eyelets−1.4 mm).

In the preferred embodiment of the present invention, the crystallized glass is mainly formed of ZnO, $B_2O_3$, $SiO_2$ and MgO.

An example of the composition of the crystallized glass is as follows:

ZnO 59% by weight $B_2O_3$ 24% by weight $SiO_2$ 12% by weight

MgO 5% by weight

According to the embodiment of the present invention as described above, the glass-bonded cathode support assembly comprises a tubular cathode support, a crystallized glass having a top surface protruding beyond the upper open end of the dish portion of the tubular cathode support, and a plurality of eyelets, and has a step of a narrow width around the top surface of the crystallized glass. Therefore, even if, during the operation of the color cathode ray, metal evaporates from the cathodes and flies over the eyelets toward the top surface of the crystallized glass, it does not deposit on at least the vertical part of the step which is shadowed when the open end of the dish portion is viewed from the open end of the eyelet. This sufficiently maintains the insulation strength between the eyelets and the dish portion of the cathode support. As a result, a dark current does not flow between the eyelets and the cathode support regardless of a potential difference between the eyelets and the cathode support, and the insulation characteristic of the color cathode tube is not deteriorated with time of operation.

Further, according to the embodiments of the present invention as described above, the crystallized glass is such that the top surface protrudes beyond the upper open end of the dish portion and the step of a narrow width is provided around the top surface. Therefore, during the firing operation of the crystallized glass, a portion of the crystallized glass protruding from the edge of the open end of the dish portion of the crystallized glass does not extend onto to the rim of the open end of the dish portion, and no cracking or chipping-off occurs in the crystallized glass. The loose particles from the crystallized glass do not stick to the components of the electron gun or to the components within the color cathode ray tube, thus resulting in no deterioration of the withstand voltage characteristics of the color cathode ray tube and no occurrence of defects of the phosphor screen.

Further, when the line-of-sight of the evaporation of the metal from the top edge of the cathodes intersects the top surface of the bonding glass 15 at a distance greater than 0.7 times a beam spacing S between two electron beams from the two adjacent cathodes, measured from the axis of the cathodes, the evaporation (or sputtering) of a metal (Ni) constituting the cathodes is prevented from forming a conductive path on the top surface of the bonding glass between the adjacent eyelets.

Figure 1:
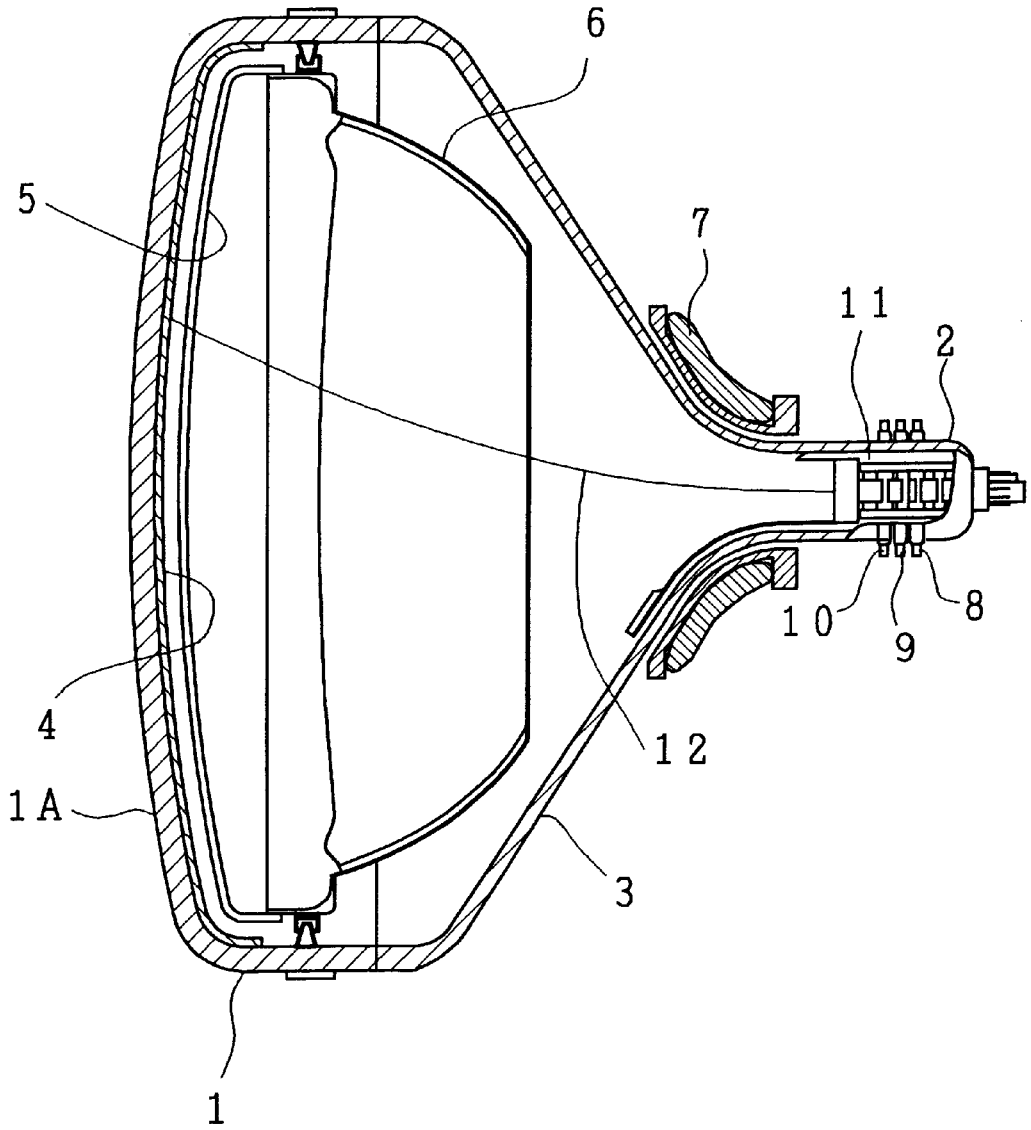
FIG. 1 is a sectional view showing a schematic constitution of an embodiment of a color cathode ray tube according to the present invention.

FIG. 1 is a sectional view showing a schematic constitution of an embodiment of a color cathode ray tube according to the present invention, showing an example in which the cathode ray tube employs an in-line type electron gun.

In FIG. 1, reference numeral 1 designates a panel portion; 1A a faceplate; 2 a neck portion; 3 a funnel portion; 4 a phosphor screen; 5 a shadow mask; 6 an internal magnetic shield; 7 a deflection yoke; 8 purity adjustment magnets; 9 four-pole static convergence adjustment magnets; 10 six-pole static convergence adjustment magnets; 11 an in-line type electron gun; and 12 an electron beam.

A vacuum envelope (glass bulb) of the color cathode ray tube comprises the panel portion 1 having the generally rectangular faceplate 1A, an elongated cylindrical neck portion 2 housing the in-line type electron gun 11 therein, and the funnel portion 3 for connecting the panel portion 1 and the neck portion 2. The inner surface of the faceplate of the panel portion 1 is coated with a phosphor film 4, and a shadow mask 5 having a multiplicity of beam apertures (not shown) is spaced from the phosphor screen 4 within the panel portion 1. The internal magnetic shield 6 is disposed internally of a portion of the funnel portion 3 closer to the panel portion 1, and the deflection yoke 7 is mounted externally of a portion closer to the neck portion 2 of the funnel portion 3. The purity adjustment magnets 8, the four-pole static convergence adjustment magnets 9, and the six-pole static convergence adjustment magnets 10 are juxtaposed externally of the neck portion 2. Three electron beams 12 (only one of which is shown in FIG. 1) emitted from the in-line type electron gun 11 are deflected in the horizontal and vertical directions by the deflection yoke 7 and impinge upon the phosphor film 4 through the electron beam apertures of the shadow mask 5.

In this case, the operation of image displaying by the color cathode ray tube of the present embodiment is much the same as that by the conventional color cathode ray tube of this kind, and such an operation is well known in the technical field. So, the explanation of the operation of image displaying by the color cathode ray tube of the present embodiment is omitted.

Figure 2:
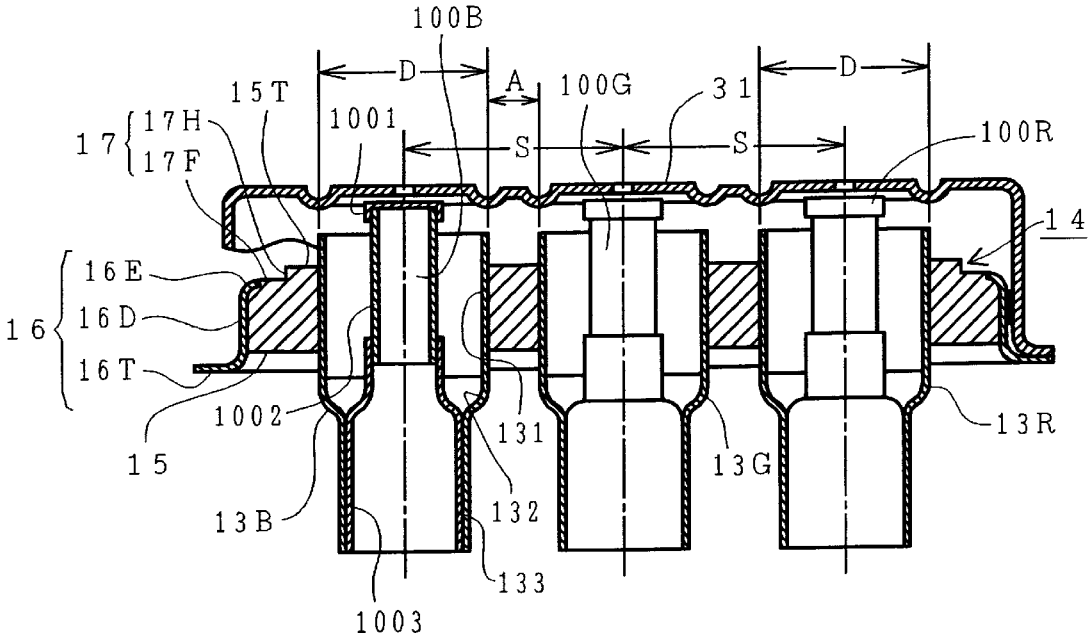
FIG. 2 is a view, partly in section, of a portion of an example of a constitution of an in-line type electron gun of the color cathode ray tube according to the present invention.

FIG. 2 is a view, partly in section, of a portion of an example of the constitution of the in-line type electron gun 11 of the color cathode ray tube shown in FIG. 1.

In FIG. 2, reference numerals 13G, 13B and 13R designate eyelets comprising a large-diameter upper portion, a small-diameter lower portion and a funnel portion connecting the large-diameter upper and small-diameter lower portions; 14 a glass-bonded cathode support assembly; 15 a low-melting-temperature crystallized glass; 16 a tubular cathode support; 16D a dish portion of the tubular cathode support 16; 16E an open end of the dish portion 16D of the tubular cathode support 16; 16T a flange of the cathode support 16; 17 a step; 17H a riser of the step 17; and 17F a tread of the step 17.

The eyelets 13G, 13B and 13R support the cathode 100G for a green electron beam, the cathode 100B for a blue electron beam, and the cathode 100R for a red electron beam, respectively. Each of the cathodes 100G, 100B and 100R comprises a cathode cap 1001 provided with an electron-emissive layer on an upper surface thereof, a cathode sleeve 1002, and a skirt portion 1003.

The glass-bonded cathode support assembly 14 comprises a low-melting-temperature crystallized glass 15, a tubular cathode support 16, and eyelets 13G, 13B and 13R, and is fixed within the cup-shaped first grip electrode 31. The tubular cathode support 16 is filled with the crystallized glass 15 so as to support the three eyelets 13G, 13B, and 13R, and the flange 16T of the cathode support 16 is welded to the open end of the cup-shaped first grid electrode 31. The crystallized glass 15 contained within the dish portion 16D has the top surface 15T which protrudes slightly beyond the upper open end 16E of the tubular cathode support 16, and the small step 17 which is provided around the top surface 15T. This small step 17 comprises a riser 17H and a tread 17F, the riser 17H having a height of 0.5 mm, and the tread 17R having a width of 0.4 mm.

In the operation of the color cathode ray tube employing the glass-bonded cathode support assembly 14 constructed as described above, even if metal evaporates from the cathodes 100G, 100B and 100R and flies toward the top surface 15T of the crystallized glass 15 beyond the eyelets 13G, 13B and 13R, a shadow zone is provided by the step 17 when the open end 16E of the dish portion 16D is viewed from the upper open end of the eyelets 13G, 13B and 13R such that the evaporated metal does not deposit on at least the riser 17H of the step 17. Therefore, the insulation strength between the eyelets 13G, 13B and 13R and the tubular cathode support 16 is sufficiently maintained. Even if there is a potential difference between the eyelets 13G, 13B and 13R and the tubular cathode support 16, a dark current does not flow between the eyelets 13G, 13B and 13R and the tubular cathode support 16, and the withstand voltage characteristics of the color cathode tube do not deteriorate with time of operation.

In the thus constructed glass-bonded cathode support assembly 14, the crystallized glass 15 has the top surface 15T protruding beyond the upper open end of the tubular cathode support 16 and the step 17 of a narrow width around the top surface 15T thereof. Therefore, a portion of the crystallized glass 15 protruding beyond the open end 16E of the cathode support 16 is prevented from extending onto the rim of the open end 16E during firing of the material of the crystallized glass 15 so that no crack or chipping-off of the protrusion of the crystallized glass 16 does not occur.

By way of a specific example, when the distance (an electron gun pitch) S between the centers of the two adjacent cathodes 100G and 100B, for example, is 5.5 mm, it is preferable that the closest distance A as defined in FIG. 2 between the two adjacent eyelets 13G and 13B is not less than 1.0 mm, and the protruding height of the eyelets beyond the top surface 15T of the low-melting-temperature crystallized glass 15 is in a range of about 0.5 mm to about 1.8 mm. Preferably, when the outside diameter D of the eyelets 13G, 13B and 13R is 4.2 mm, the closest distance A as defined in FIG. 2 of approximately 1.3 mm retains the insulation strength between the eyelets 13G, 13B and 13R and the dish portion 16D sufficiently.

Generally, if the distance S (mm) between the centers of the two adjacent cathodes and the eyelet diameter D satisfy a relationship of $(S-2.0\text{ mm}) \leqq D \leqq (S-0.5\text{ mm})$, the insulation strength between the eyelets 13G, 13B and 13R and the dish portion 16D of the cathode support 16 is sufficiently maintained.

While in the above-described embodiment, a description has been made of an example in which the step 17 has a riser 17H of 0.5 mm in height and a tread 17F of 0.4 mm in width, the step 17 is not limited to one having the aforementioned dimensions, but if the step 17 has a riser 17H in a range of from 0.1 mm to 1.2 mm in height and a tread 17F in a range of from 0.1 to 1.0 mm in width, the advantages similar to those of the previous embodiment can be achieved.

If the height of the riser 17H is set to 0.1 mm or less, the step 17 does not provides the significant advantages, and if the height of the riser 17H is 1.2 mm or more, the relationship between the overall thickness of the crystallized glass 15 and the height of the step 17 is imbalanced. Further, if the width of the tread 17F is 0.1 mm or less, a portion of the crystallized glass 15 protruding beyond the open end 16E of the dish portion 16D extends onto the rim of the open end 16E, resulting in occurrence of crack or chipping-off of the portion and if the width of the tread 17F is 1.0 mm or more, not only the mechanism for fixing the glass-bonded cathode support assembly into the cup-shaped first grid electrode becomes complicated, but also the annular crystallized glass 15 disposed around the eyelets 13G, 13B and 13R becomes excessively thin.

In consideration of productivity, preferably, the height of the riser 17H is in a range of from 0.2 mm to 0.7 mm, and the width of the tread 17F is in a range of from 0.2 mm to 0.7 mm.

Further, while in the above-described embodiment, a description has been made of an example in which the low-melting-temperature crystallized glass 15 is formed mainly of ZnO, the principal ingredient of the low-melting-temperature crystallized glass 15 used in the present invention is not limited to ZnO, but other materials, for example, $B_2O_3$, $SiO_2$ or MgO may be used as the principal ingredient.

Figure 3:
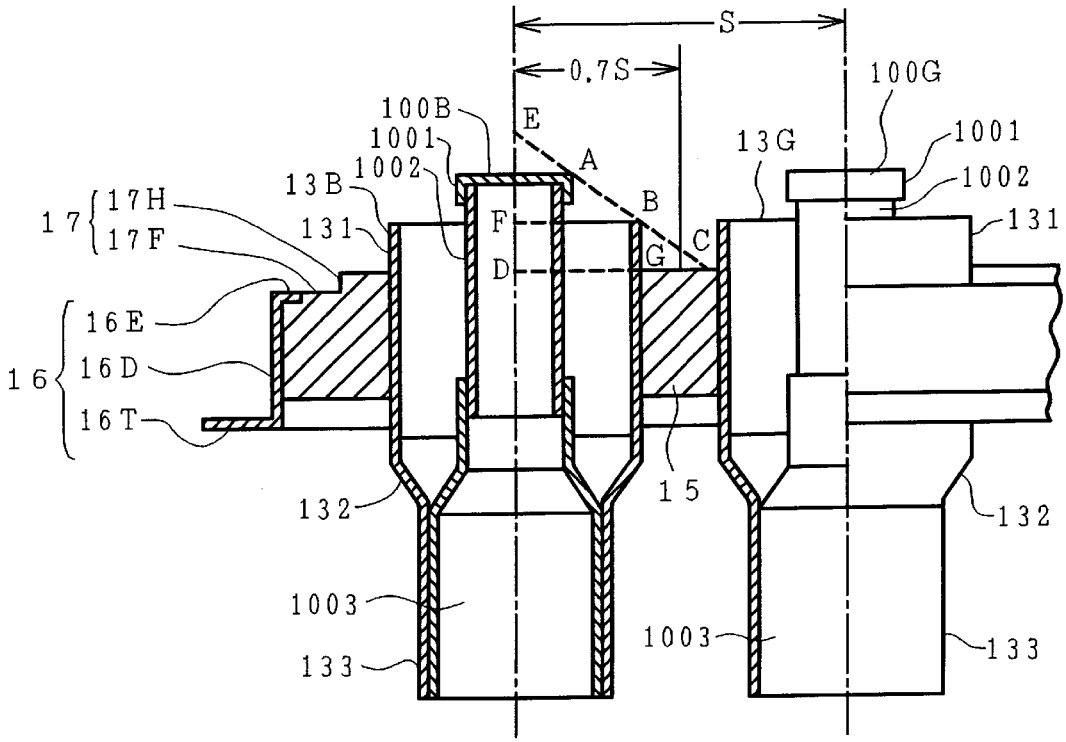
FIG. 3 is a more greatly enlarged view, partly in section, of the portion of the electron gun shown in FIG. 2.

FIG. 3 is a more greatly enlarged view, partly in section, of the portion of the electron gun shown in FIG. 2. Referring to FIG. 3, the inventors of the present invention have found that, for prevention of the evaporation (or sputtering) of a metal (Ni) constituting the cathodes 100B, 100G and 100R from forming a conductive path on the top surface 15T of the bonding glass 15 between the adjacent eyelets 13B, 13G and 13R, it is preferable that the line-of-sight of the evaporation of the metal from the top edge of the cathodes intersects the top surface 15T of the bonding glass 15 at a distance greater than 0.7 times a beams spacing S between two electron beams from the two adjacent cathodes, measured from the axis of the cathode 100B. This preferable relationship is illustrated in FIG. 3, and the line-of-sight AB of the evaporation of the metal from the top edge A of the cathode cap 1001 of the cathode 100B through the top edge B of the large-diameter upper portion 131 of the eyelet 13B intersects at a position C with the top surface 15T of the bonding glass 15. The distance CD indicated in FIG. 3 is preferably not less than 0.7 S. The area CG which is shadowed when viewed from the top edge A of the cathode cap 1001 is produced around the eyelets 13B and prevents occurrence of a conductive path between the eyelets 13B and 13G. The distance CD need not be greater than 1.0 S.

The relationship obtained by the inventors for preventing the evaporation of a metal (Ni) constituting the cathodes 100B, 100G and 100R from forming a conductive path on the top surface 15T of the bonding glass 15 between the adjacent eyelets is:

$$1.0\ S \geqq \text{a distance } CD \geqq 0.7\ S \tag{1}$$

The inventors of the present invention have found that, when the line-of-sight AB is projected back to the axis of the cathode 100B, the intersection of the line-of-sight AB with the axis can be assumed to be 1.4 mm measured from the top end of the eyelet 13B for most of practical cathode ray tubes using oxide cathodes, that is, the distance EF is 1.4 mm. The outside diameter of the large-diameter portion 131 of the eyelets 13B, 13G and 13R is usually in a range of 0.7 to 0.9 times the beam spacing S. The outside diameter of the cathode cap 1001 is usually in a range of from 1.5 mm to 1.8 mm. The shapes and spacing of the construction are greatly exaggerated in FIG. 3 for clarity.

In a triangle ECD in FIG. 3, the relationship DE/DC=BG/CG exists, that is, $$(EF+BG)/CD=BG/(CD-DG) \tag{2}$$

where

EF=1.4 mm,

BG=a height of the eyelet 13B protruding beyond the top surface 15T,

DG=an outside radius of the eyelet 13B, and

CD=a distance from the axis of the cathode 100B to a point where the assumed line-of-sight of the evaporation of the metal from the top edge of the cathode passing through the top edge of the eyelet 13B intersects the top surface 15T of the bonding glass 15, assuming EF=1.4 mm.

Solving the equation (2) for the distance CD by substituting 1.4 mm for EF gives $$CD=(1.4DG+BG\cdot DG)/1.4 \tag{3}$$

Substitution of the equation (3) into the equation (1) gives $$1.4S/DG-1.4 \geqq BG \geqq 0.98S/DG-1.4 \tag{4}$$

Namely, (1.4 times the beam spacing S divided by the outside radius of the eyelet−1.4 mm)≧the height of the eyelet protruding beyond the top surface of the bonding glass≧(0.98 times the beam spacing S divided by the outside radius of the eyelet−1.4 mm)

Dimensional Example the outside diameter of the eyelet=4.4 mm, the height of the eyelet protruding beyond the top surface of the bonding glass=1.2 mm, the width of the step=0.3 mm, and the height of the step=0.4 mm.

These values satisfy the equation (4) above as shown below.

$$1.4\times5.5\ \text{mm}/2.2\ \text{mm}-1.4\ \text{mm}=2.1\ \text{mm} \geqq 1.2\ \text{mm} \geqq 0.98\times5.5\ \text{mm}/2.2\ \text{mm}-1.4\ \text{mm}=1.05\ \text{mm}$$

The equation (3) above gives $$CD=(1.4DG+BG\cdot DG)/1.4=(1.4\times2.2+1.2\times2.2)/1.4=4.09\ \text{mm}$$

As described above, according to the present invention, the glass-bonded cathode support assembly includes a tubular cathode support and a crystallized glass having a top surface thereof protruding beyond the open end of a dish portion of the tubular cathode support and a step of a narrow width around the top surface. Therefore, if, during the operation of the color cathode ray tube, metal evaporates from cathodes and flies toward the top surface of the crystallized glass beyond the eyelets, the evaporated metal does not deposit on a portion of the step which is shadowed when the edge of the upper open end of the tubular cathode support is viewed from the open end of the eyelets, at least a vertical part of the step, and therefore, the sufficient insulation strength is maintained between the eyelets and the dish portion of the tubular cathode support. As a result, a dark current does not flow between the eyelets and the cathode support regardless of a potential difference therebetween, and the insulation characteristics of the color cathode ray tube do not deteriorate with time of operation.

Further, when the relationship between the height of the eyelet protruding beyond the top surface of the bonding glass and the outside radius of the eyelet is properly set as described above, even if metal evaporates from the cathodes, a leakage path is prevented from forming between the adjacent eyelets.

Further, according to the present invention, the crystallized glass has the top surface protruding beyond the upper open end of tubular cathode support and the step of a narrow width around the top surface. Therefore, during the firing operation of the crystallized glass, a portion of the protruding crystallized glass is prevented from moving toward and extending onto the rim of the opening of the tubular cathode support and crack or chipping-off does not occur in the crystallized glass. The present invention provides the advantages that loose particles created by chipping-off of the crystallized glass do not deposit on the components of the electron gun or other components within the color cathode tube, and deterioration of the withstand voltage characteristics of the color cathode ray tube and defects of the phosphor screen are prevented.

What is claimed is:

1. A color cathode ray tube comprising at least an evacuated envelope comprising a panel portion having a phosphor screen formed on an inner surface thereof, a neck portion, and a funnel portion connecting said panel portion and said neck portion, a shadow mask spaced from said phosphor screen and suspended within said panel portion, an electron gun housed in said neck portion comprising at least a plurality of cathodes, a cup-shaped first grid electrode spaced from said plurality of cathodes and a plurality of electrodes spaced between said first grid electrode and said shadow mask for generating and directing a plurality of electron beams toward said phosphor screen, and a deflection yoke mounted in the vicinity of the junction between said neck portion and said funnel portion, said plurality of cathodes being supported within a plurality of eyelets corresponding to the number of said cathodes, respectively, each of said plurality of eyelets comprising a large-diameter upper portion facing said cup-shaped first grid electrode, a small-diameter lower portion for supporting said plurality of cathodes and a funnel portion for connecting said large-diameter upper portion and said small-diameter lower portion, and being disposed within and bonded to a tubular cathode support at said large-diameter upper portion thereof by a bonding glass contained within said tubular cathode support, and said tubular cathode support being disposed within and fixed to said first grid electrode, wherein said bonding glass provides a protrusion beyond an upper open end of said tubular cathode support, said protrusion is provided with a depressed step around a top edge thereof, and (1.4 times a beam spacing S between two electron beams from two adjacent ones of said plurality of cathodes divided by an outside radius of said plurality of eyelets−1.4 mm)≧(a height of said plurality of eyelets protruding beyond a top surface of said bonding glass) ≧(0.98 times said beam spacing S divided by said outside radius of said plurality of eyelets−1.4 mm).

2. A color cathode ray tube according to claim 1, wherein a diameter of said large-diameter upper portion of said plurality of eyelets is in a range of 0.7 to 0.9 times said beam spacing.

3. A color cathode ray tube according to claim 1, wherein a width of said depressed step is in a range of 0.1 mm to 1.0 mm and a height of a vertical part of said depressed step is in a range of 0.1 mm to 1.2 mm.

4. A color cathode ray tube according to claim 3, wherein said width of said depressed step is in a range of 0.2 mm to 0.7 mm and said height of said vertical part of said depressed step is in a range of 0.2 mm to 0.7 mm.

5. A color cathode ray tube according to claim 1, wherein said bonding glass comprises ZnO, $B_2O_3$, $SiO_2$ and MgO.

* * * * *